United States Patent [19]

Sturwold

[11] 4,359,393

[45] Nov. 16, 1982

[54] WATER ACTIVE METALWORKING LUBRICANT COMPOSITIONS

[75] Inventor: Robert J. Sturwold, Cincinnati, Ohio

[73] Assignee: The Cincinnati Vulcan Company, Cincinnati, Ohio

[21] Appl. No.: 241,619

[22] Filed: Mar. 9, 1981

[51] Int. Cl.[3] ..... C10M 1/32; C10M 3/26; C10M 5/20

[52] U.S. Cl. ..... 252/34.7; 252/49.3; 72/42

[58] Field of Search ..... 252/34.7, 49.3; 72/42

[56] References Cited

U.S. PATENT DOCUMENTS

| | | | |
|---|---|---|---|
| 3,419,494 | 12/1968 | Teeter et al. | 252/34.7 |
| 3,442,805 | 5/1969 | Johnson | 252/34.7 |
| 3,630,898 | 12/1971 | Teeter et al. | 252/34.7 |
| 3,860,521 | 1/1975 | Aepli et al. | 252/34.7 |
| 3,897,349 | 7/1975 | Marin et al. | 252/34.7 X |
| 4,075,393 | 2/1978 | Sturwold | 428/457 |
| 4,108,785 | 8/1978 | Sturwold | 252/56 R |
| 4,132,662 | 1/1979 | Sturwold | 252/56 R |
| 4,149,983 | 4/1979 | Grier et al. | 252/49.5 |
| 4,151,099 | 4/1979 | Nassry et al. | 252/32.70 |
| 4,153,464 | 5/1979 | Sturwold et al. | 106/14.27 |
| 4,160,370 | 7/1979 | Hacias | 72/42 |
| 4,172,802 | 10/1979 | Rieder | 252/49.3 |
| 4,178,260 | 12/1979 | Cook et al. | 252/49.8 |

*Primary Examiner*—Paul F. Shaver
*Attorney, Agent, or Firm*—Wood, Herron & Evans

[57] ABSTRACT

This invention relates to water active metalworking lubricant compositions, particularly for the cold rolling of aluminum and other sensitive non-ferrous metals and alloys. Water emulsions or solutions of the lubricant composition provide good lubricity and anti-wear properties and furthermore, prevent water staining of aluminum. The water active lubricant composition contains (a) an alkanolamine salt of a $C_{36}$ dimer or $C_{54}$ trimer acid, (b) an aliphatic monoalcohol or monocarboxylic acid and (c) an alkyl ester of a fatty acid.

12 Claims, No Drawings

WATER ACTIVE METALWORKING LUBRICANT COMPOSITIONS

BACKGROUND OF THE INVENTION

Aqueous metalworking fluids have long been established in the art and used in metalworking processes such as rolling, stamping, drawing, cutting, and extruding. Such fluids lubricate and cool the metal during the working process and this promotes long tool life which aids in increased production and the attainment of high quality finished metal products. Many attempts have been made to provide useful lubricant compositions which are either oil based or aqueous based fluids as disclosed in U.S. Pat. Nos. 4,075,393; 4,108,785; 4,132,662; 4,149,983; 4,151,099; 4,153,464; 4,160,370; 4,172,802; and 4,178,260.

The above patents represent a number of approaches that have been taken by the metalworking industry in an attempt to provide good lubricating and anti-wear properties in metalworking libricant compositions, and to minimize other problems such as water staining of sensitive non-ferrous metals and alloys. Lubricants are employed in cold rolling or sheet metalworking processes to prevent damage to the surface of the metal and to facilitate the operation. For instance, when cold rolling aluminum and other sensitive metals, oil based lubricants are employed to insure sheets of uniform thickness and undesirable surface defects. An ideal lubricant for the cold rolling of aluminum and other sensitive non-ferrous alloys would be a water active product in an aqueous system. This would have a cooling effect during the rolling operation thereby allowing an increase in mill speed. However, aluminum and aluminum alloys are susceptible to water staining. The staining appears as blemishes on the surface of the metal and in some cases pitting occurs. In addition to creating an appearance problem the staining interferes with subsequent operations such as drawing, stamping, cutting, and so forth.

It would be highly advantageous if aqueous metalworking lubricant compositions were available, particularly for use in the cold rolling of aluminum and other sensitive non-ferrous alloys to provide proper lubrication but without water staining.

SUMMARY OF THE INVENTION

Water active lubricating compositions for metalworking, such as for cold rolling aluminum and aluminum alloys, are provided by this invention. In comparison to other aqueous lubricant compositions, the water active lubricants of this invention unexpectedly produce good lubricity and anti-wear properties and, furthermore, prevent water staining of aluminum and other sensitive non-ferrous metals and alloys. The compositions are especially useful in the cold rolling of aluminum.

The water active metalworking lubricants of this invention contain (a) an alkanol amine salt of a polymeric fatty acid, (b) an aliphatic monoalcohol or a monocarboxylic acid and (c) an alkyl ester of a fatty acid. More particularly, a water active metal rolling composition for the prevention of water staining in metal sheets of aluminum and aluminum alloys contains (a) an alkanolamine salt of a polymeric fatty acid selected from the group consisting of a $C_{36}$ dimer acid, a $C_{54}$ trimer acid and mixtures thereof, wherein said alkanolamine is selected from the group consisting of monoethanolamine, diethanolamine, triethanolamine and triisopropanolamine, (b) a fatty alcohol or a fatty acid containing from about 12 to about 22 carbon atoms, and (c) a lower alkayl ester of a fatty acid containing from about 12 to about 22 carbon atoms.

DETAILED DESCRIPTION

An alkanolamine salt of a polymeric fatty acid, that is a $C_{36}$ dimer or $C_{54}$ trimer acid, is an essential component of the water active metalworking compositions of this invention. These salts provide in combination with the other components of the composition lubricating characteristics and particularly the prevention of water staining of metals such as aluminum and other sensitive non-ferrous metals and alloys. While the water active lubricating composition is especially suitable for use in the cold rolling of aluminum sheet and other sensitive non-ferrous metals and alloys, the blends are not restricted to use in this area. Their performance properties make them also useful for the working or cold rolling of steel and other ferrous alloys even though their unique properties, such as water staining protection, are usually not a requirement for the cold rolling of steel. The alkanolamine salts of the polymeric fatty acids are obtained by simply stirring the alkanolamine and polymeric fatty acid with gentle warming for a short period of time, usually for about 1–2 hours. The polymeric acids are obtained by the polymerization of unsaturated monocarboxylic acids. For instance, the $C_{36}$ dimer or $C_{54}$ trimer acids are obtained by the dimerization or trimerization of oleic acid, linoleic acid or mixtures thereof (e.g. tall oil fatty acids). The dimer acid has as its principal component a $C_{36}$ dibasic acid and the trimer acid has a $C_{54}$ tribasic acid as its main component. Such $C_{36}$ dibasic or $C_{54}$ tribasic acids are commercially available under the trademark EMPOL Dimer or Trimer Acids by Emery Industries. Dimer acids containing greater than 75% by weight, and preferably more than 90% by weight, of $C_{36}$ dibasic acid having iodine values in the range of about 90–110 are commercially available and are useful. In addition, hydrogenated dimers having a maximum iodine value of about 35 and preferably not greater than 20, have also been found to be useful and are commercially available. Typically, in addition to the described $C_{36}$ dibasic acid content and iodine value, these dimer acids will have an acid value between about 180–215, saponification value from 190–205 and neutral equivalent of about 265–300. Trimer acids are usually contained in the dimer acid in small amounts of up to about 25% by weight. Also, 90% $C_{54}$ trimer acid containing about 10% $C_{36}$ dimer acid is available as EMPOL 1040 and is suitable for use in this invention.

The alkanolamine which forms the salt of the polymeric fatty acid may be selected from any one of a number of the alkanolamines, wherein the alkyl portion is usually lower alkyl, i.e., $C_1$–$C_4$. In particular, the alkanolamines may be selected from the group consisting of monoethanolamine, diethanolamine, triethanolamine and triisopropanolamine, and the like. Such alkanolamines are characterized by the presence of the hydroxyl group in order to lend the salts of the polymeric fatty acids water active. Therefore, other substituents may be present in the amine group providing that at least one hydroxyl group remains and therefore other lower alkanolamines are suitable such as dimethyl methanolamine.

An aliphatic monoalcohol or an aliphatic monocarboxylic acid having about 2 to about 22 carbon atoms is included with the alkanolamine salt of the polymeric fatty acid primarily to achieve a compatible blend. Aliphatic alcohols suitable for this purpose may be either branched or straight-chain and can be saturated or unsaturated. Suitable alcohols include but are not limited to ethanol, isopropyl alcohol, octanol, nonyl alcohol, lauryl alcohol, myristyl alcohol, cetyl alcohol, stearyl alcohol, oleyl alcohol, linoleyl alcohol, tridecyl alcohol, and mixtures thereof. Preferably, the fatty alcohols usually having from about 12 to about 22 carbon atoms are preferred for several reasons including their ability to provide compatible blends, lubricate, provide a good metal surface finish and they are not volatilized as the lower alcohols may be during use. Especially useful in view of their commercial availability are mixtures of the fatty alcohols. Similarly, the aliphatic monocarboxylic acids having from about 2 to about 22 carbon atoms, preferably fatty acids, are employed as in the case of the fatty alcohols. Suitable aliphatic monocarboxylic acids include but are not limited to acetic acid, lauric acid, palmitic acid, oleic acid, linoleic acid, linolenic acid, stearic acid, myristic acid, undecalinic acid, ricinoleic acid, arachidic acid, behenic acid and mixtures thereof.

The fatty alkyl ester is derived from a fatty acid, typically having from about $C_{12}$ to about $C_{22}$ carbon atoms. Lower alkyl esters of these acids, where the alkyl group contains from about 1 to about 4 carbon atoms, are especially advantageous for the formulation of the lubricant compositions of this invention. The lower molecular weight alkyl esters of a fatty acid also give a good surface finish to the rolled strip. The alkyl ester has been found to be an essential component of the combination of the alkanolamine salt of the polymeric fatty acid and a fatty alcohol or acid in order to obtain the bundle of desirable properties of the rolling oil composition. Methyl esters are particularly advantageous and especially useful are methyl esters of $C_{12}$ to about $C_{18}$ fatty acids or mixtures of these fatty acids. The fatty acids may be saturated or unsaturated without adversely affecting the desirable properties of the lubricant composition.

The water active lubricant is contained in an aqueous medium in amounts of about 1% to 10%, or more, usually between about 2% to 5% in emulsion or solution form. The components of the lubricant composition are contained in varying amounts to obtain the improved water active characteristics of this invention. The alkanolamine salt of the polymeric fatty acid is contained from about 30 to about 60% by weight of the total three-component composition. The aliphatic monoalcohol or carboxylic acid constitutes from about 20 to about 40% by weight and the fatty alkyl ester constitutes the remaining amount of from about 20–40% by weight. In the case of the alkanolamine salt of the polymeric fatty acid, the acid is contained within a range of about 0.3 to about 1 equivalents of the acid to 1 of the alkanolamine. Higher acid ratios do not tend to give good emulsions and, in the case where the prevention of water staining is essential, such as with aluminum or aluminum alloy, lower ratios do not prevent water staining. Accordingly, on a percent by weight basis, the acid is usually contained in the salt form from about 10–13% by weight based on the three-component system. When the three components are present in the lubricant composition, it has been found that aqueous emulsions or solutions of the blend have good anti-wear and extreme pressure properties as measured by a Falex machine. It has also been found that the alkanolamine salt of the polymeric fatty acid prevents water staining of aluminum strip and aluminum alloys and, furthermore, provides sufficient surfactant activity to give stable emulsions. Therefore, the invention has a particular utility in the area of lubricating compositions for aluminum and aluminum alloys during cold forming operations, such as cold rolling, where water staining of aluminum is a particular problem. The blends, however, are not restricted to this use area because their performance properties make them especially useful for the cold rolling of steel and other ferrous alloys. However, their unique properties, such as the water stain protection, are usually not a requirement for the cold rolling of steel.

A number of unexpected properties and results have been achieved with the three-component water active lubricant composition of this invention. First, the blend of (a) an alkanolamine salt of a polymeric fatty acid, e.g., a $C_{36}$ dibasic acid, (b) an alkyl ester of a fatty acid and (c) an aliphatic monoalcohol or carboxylic acid, especially a fatty alcohol or acid, has been found to provide an aqueous lubricant composition. The alkanolamine salt of the dimer acid has been found to prevent water staining of aluminum and aluminum alloy surfaces even though it is based in an aqueous system. Furthermore, the amine salt of the dimer acid has been found to provide sufficient surfactant activity to give stable emulsions in the composition. Aqueous emulsions of the blend have good anti-wear and extreme pressure properties. The behavior of the alkanolamine salts of dimer acid in the prevention of water staining of aluminum is considered to be unexpected because alkanolamine salts of other fatty acids and fatty acid derivatives do not prevent water stains. Only the alkanolamine salts of the dimer acid have been found to provide the desirable water active products or aqueous emulsions. Blends containing the dimer acid, alkyl esters of fatty acids, fatty alcohols or acids, in an emulsifier to obtain a water active system either do not prevent water staining of aluminum or do not give stable emulsions or systems. Furthermore, aqueous emulsions of the latter types show excessive wear. It has also been found that a fatty alcohol or fatty acid must be included in the blend in order to obtain compatibility and the blend must contain a minimal amount of a dimer acid in the salt in order to obtain water stain protection. The alkyl ester in the blend along with the alkanolamine salt of the dimer acid and a fatty alcohol or acid is necessary in order to achieve a compatible system, and to provide the other advantageous properties including surface finish. As mentioned above, a range of about 0.3 to about 1.0 equivalents of the dimer acid to the alkanolamine in the salt is necessary in order to provide good emulsions or water activity and the prevention of water staining where such a property is desired in connection with aluminum rolling operations. Other components may of course be employed in the composition such as lard oil providing a suitable coupling agent is also used. While it has been found that branched or straight-chained alcohols, esters or acids may be employed, preferably alcohols, acids or esters having straight as opposed to branched chains provide more compatible systems.

DETAILED OPERATING EXAMPLES

The following examples, data and tables illustrate the invention more fully. These examples also demonstrate the invention in comparison to the employment of other components in order to illustrate the superior advantages and unexpected properties of the metalworking oil compositions of this invention. However, the examples hereinafter following are merely illustrative and are not intended as a limitation on the scope of this invention. All parts and percentages are on a weight basis unless otherwise indicated. The examples further illustrate the lubricant compositions, numerous variations thereof, and particular utility of the compositions in connection with the working of aluminum and aluminum alloys.

Various test procedures were employed in connection with the following examples and tables. In the water stain test, clean aluminum strips are dipped into a water emulsion or solution of the lubricant sample under test. The strip was then allowed to air dry following which it was suspended ¼ of an inch in front of the side-arm of a filtration flask containing vigorously boiling water. After ten minutes spray time, the strips were examined for water stain. The anti-wear and extreme pressure properties were measured by the use of a Falex machine. Units of wear at a loading of 700 lbs. for fifteen minutes were measured on water emulsions or solutions of the samples. The sum of the readings is reported as "Units Wear" in the tables. The load was then increased until failure which was taken as the extreme pressure load of the sample and this is reported in the tables as the "EP" value for the sample.

Several different alkanolamine salts of dimer acid using different acid/amine ratios were prepared. A dimer acid employed hereinafter as "E-1018" is a $C_{36}$ dibasic acid (EMPOL 1018 Dimer Acid containing about 15% $C_{54}$ tribasic acid). The alkanolamine salts were prepared by stirring the alkanolamine and dimer acid with gentle warming for about 1 to about 2 hours. Then, blends of the salts, fatty alcohol and fatty alkyl ester were made and the properties were determined. The data are presented in Table I.

TABLE I

DIFFERENT DIMER ACID/TRIETHANOLAMINE RATIOS

| | | | | | |
|---|---|---|---|---|---|
| Composition In Equivalents: | | | | | |
| E-1018 Dimer Acid | .1 | .3 | .5 | .7 | 1.0 |
| Triethanolamine (TEA) | 1.0 | 1.0 | 1.0 | 1.0 | 1.0 |
| Blend Composition (Weight Percent) | | | | | |
| Dimer Acid/TEA Salt | 35 | 40 | 45 | 45 | 45 |
| Fatty Alcohol (mixture of $C_{12}$ and $C_{14}$ alcohol) | 35 | 30 | 25 | 25 | 25 |
| Fatty Methyl Ester (mixture of $C_{16}$ and $C_{18}$ methyl ester) | 30 | 30 | 30 | 30 | 30 |
| Properties | | | | | |
| Compatibility | OK | OK | OK | OK | OK |
| Emulsion Stability | POOR | OK | OK | OK | OK |
| Water Stain Test 5% Emulsion | STAIN | OK | OK | OK | OK |

A number of triethanolamine salts of dimer acid were prepared in equivalent ratios of between about 0.1–1.0 of the acid to about 1 of the amine. Blends of these salts were then made with a fatty alcohol mixture and a fatty methyl ester mixture. The blends containing 0.1 and 0.3 equivalents of the dimer acid and the dimer acid salt, required a higher alcohol level for compatibility. However, as demonstrated by Table I, below 0.3 equivalents of dimer acid in the salt, poor emulsion stability and staining occurred. Accordingly, in accordance with the data of Table I, a minimal amount of the dimer acid in the salt is required in order to obtain water stain protection and emulsion stability. Furthermore, Table I illustrates that varying amounts of the components in the three-component system may be employed with satisfactory results.

Dimer acid salts were prepared using different alkanolamines at 0.5/1.0 equivalent ratio of the dimer acid to the alkanolamine. The salts were then blended with a fatty alcohol and a fatty alkyl ester and the properties were determined as presented in Table II.

TABLE II

DIFFERENT ALKANOLAMINES

| | | | | |
|---|---|---|---|---|
| Salt Composition Equivalents: | | | | |
| E-1018 Dimer Acid | .5 | .5 | .5 | .5 |
| Monoethanolamine | 1.0 | | | |
| Diethanolamine | | 1.0 | | |
| Triethanolamine | | | 1.0 | |
| Triisopropanolamine | | | | 1.0 |
| Blend Composition (Weight Percent) | | | | |
| Dimer Acid/Amine Salt | 50 | 50 | 50 | 50 |
| Fatty Alcohol (mixture of $C_{12}$ and $C_{14}$ alcohol) | 20 | 20 | 20 | 20 |
| Fatty Methyl Ester (mixture of $C_{16}$ and $C_{18}$ methyl ester) | 30 | 30 | 30 | 30 |
| Properties | | | | |
| Compatability | OK | OK | OK | OK |
| Emulsion Stability | OK | OK | OK | OK |
| Water Stain Test 5% Emulsion | OK | OK | OK | OK |

In the case of the monoethanolamine dimer acid salt, diethanolamine dimer acid salt, triethanolamine dimer acid salt and triisopropanolamine dimer acid salt, satisfactory blend compositions were obtained demonstrating compatibility, emulsion stability and water stain resistance. Therefore, it will be appreciated that various alkanolamine salts may be prepared from a dimer acid or trimer acid, and these salts may in turn be blended with a fatty alcohol or fatty acid and a fatty methyl ester in order to provide water active lubricating compositions with water stain resistance.

Lubricating compositions containing different amounts of fatty alcohol and fatty alcohol esters were prepared. In this series of experiments, a triethanolamine salt of dimer acid was employed with varying ratios of between about 10–50% by weight of fatty alcohol and between about 30–50% by weight of a fatty methyl ester. The amine salts of dimer acid were prepared in a 0.5/1.0 equivalent ratio. The data are presented in Table III.

TABLE III

DIFFERENT ESTER RATIOS

| | | | | |
|---|---|---|---|---|
| Composition Weight Percent | | | | |
| E-1018 Dimer Acid/TEA Salt | 50 | 50 | 50 | 50 |
| Fatty Alcohol (mixture of $C_{12}$ and $C_{14}$ alcohol) | 50 | 20 | 10 | |
| Fatty Methyl Ester (mixture of $C_{16}$ and | | | | |

TABLE III-continued

| DIFFERENT ESTER RATIOS | | | | | |
|---|---|---|---|---|---|
| $C_{18}$ methyl ester) | | | 30 | 40 | 50 |
| Properties | | | | | |
| Compatibility | | OK | OK | NC | NC |
| Emulsion Stability | | OK | OK | | |
| Water Stain Test | | | | | |
| 5% Emulsion | | OK | OK | | |
| Falex Test | | | | | |
| 5% Emulsion | | | | | |
| (2%) Emulsion | | | | | |
| Units Wear | | 29 | (2) | | |
| EP | | 3100 | (3200) | | |

On the one hand, the data of Table III illustrate that the presence of the alcohol in the three-component system is important in order to achieve compatibility. Furthermore, Table III also illustrates that varying amounts of the three components within certain ranges is important in order to achieve compatibility, emulsion stability and water stain resistance. In the case of the Falex test, as indicated in the table for both 5% and 2% emulsions, the number of wear readings for the composition without the ester indicated that the ester is needed to obtain advantageous wear.

Blends were also made of the dimer acid salt (at 0.5/1.0 equivalent ratio of the dimer acid to the triethanolamine) and different alcohols. Furthermore, in certain of the examples, no ester component was employed to illustrate the necessity of the ester component in achieving either emulsion stability or activity or water stain resistance. These data are presented in Table IV and included for comparison are Falex tests of mainly 2% and 5% emulsions with a sample of 1% emulsion.

TABLE IV

| DIFFERENT ALCOHOLS | | | | | | | | | | | | |
|---|---|---|---|---|---|---|---|---|---|---|---|---|
| Composition Weight Percent | | | | | | | | | | | | |
| E-1018 Dimer Acid Salt | 50 | 50 | 50 | 50 | 50 | 50 | 50 | 50 | 50 | 50 | 50 | 50 |
| Fatty Methyl Ester (mixture of $C_{12}$ and $C_{18}$ methyl ester) | 30 | | 30 | | 30 | | 30 | | 30 | | 30 | |
| Ethanol | 20 | 50 | | | | | | | | | | |
| Isopropyl Alcohol | | | 20 | 50 | | | | | | | | |
| Octanol | | | | | 20 | 50 | | | | | | |
| Fatty Alcohol (mixture of $C_{12}$ and $C_{14}$ alcohol) | | | | | | | 20 | 50 | | | | |
| Fatty Alcohol (mixture of $C_{16}$ and $C_{18}$ alcohol) | | | | | | | | | 20 | 50 | | |
| Tridecyl Alcohol | | | | | | | | | | | 20 | 50 |
| Properties | | | | | | | | | | | | |
| Appearance | CLEAR | OK | CLEAR | OK | CLEAR | OK | CLEAR | OK | CLEAR | OK | CLEAR | OK |
| Emulsion Stability | GOOD | SOLUBLE | GOOD | SOLUBLE | GOOD | OK | GOOD | OK | GOOD | OK | GOOD | OK |
| Water Stain 2% | NONE | | NONE | | NONE | | NONE | OK | NONE | OK | NONE | OK |
| (5%) | NONE | STAIN | NONE | STAIN | NONE | STAIN | NONE | OK | NONE | OK | NONE | OK |
| Falex 2% | | | | | | | | | | | | |
| (5%) | | | | | | | | | | | | |
| Units Wear | | (75) | 2 | (42) | 0 | (24) | 19* | (29) | 0 | (14) | 3 | (14) |
| EP | | (3300) | 2650 | (3350) | 2900 | (3500) | 3350 | (3100) | 2700 | (2500) | 2650 | (2950) |

*1% Emulsion

As demonstrated in Table IV, ethanol, isopropyl alcohol, octanol, $C_{12}$–$C_{14}$ alcohol, $C_{16}$–$C_{18}$ alcohol and tridecyl alcohol all provided compatible systems as evidenced by the clarity in appearance. The designation "Clear" and "OK" are equivalent terms indicating clarity or compatibility. In terms of emulsion stability, similarly, the terms "Good" and "OK" are equivalent terms indicating emulsion stability and "Soluble" indicates that the composition was soluble in water. Various emulsions with water of either 1%, 2% or 5% of the water active lubricant were made as indicated in Table IV. The compositions containing ethanol, isopropanol and octanol, in the absence of the fatty methyl ester, did not provide water stain resistance and the Falex test demonstrated a fairly excessive wear between about 24–75 units for the 5% solution. In the case of the longer chain alcohols alone of $C_{12}$ through $C_{18}$ and tridecyl alcohol at the 5% emulsion level, the blends demonstrated water stain resistance and emulsion stability, and less wear, i.e., between 14–29 units of wear, in contrast to the lower alcohols. Where all three components in accordance with the principles of the invention were employed, 0 to only 3 units of wear were observed for 2% emulsion. Accordingly, Table IV illustrates that the three-component system of this invention including a $C_{36}$ dimer acid (containing trimer acid), fatty methyl ester and $C_2$–$C_{18}$ alcohols do provide lubricant compositions which are water active in providing soluble or stable emulsions having water stain resistance and excellent wear characteristics. It should also be mentioned that in the cases of both isopropyl alcohol and tridecyl alcohol when blended with the dimer salt and methyl ester that clarity was only achieved while hot and that haziness existed at room temperature indicating a slight incompatibility of the blend. Accordingly, in accordance with the preferred principles of this invention straight-chained aliphatic alcohols or esters are preferred in order to achieve complete compatibility. In the data reported in Table IV, it should also be observed that the 19 wear units were reported for the $C_{12}$–$C_{14}$ alcohol blend but it was run on a 1% emulsion and therefore, is not directly comparable to the other values which were performed at both 2% and 5% levels.

Blends were made using different levels of dimer acid/amine salt to determine the effect on anti-wear properties and emulsion stability. Both fatty and non-fatty alcohols were used to achieve compatibility. The dimer/amine salt used was dimer acid/TEA at an equivalent ratio of 0.5/1.0. The data are presented in Table V.

TABLE V

EFFECT OF DIMER ACID/TRIETHANOLAMINE SALT LEVEL

| Composition Weight Percent | | | | | |
|---|---|---|---|---|---|
| E-1018 Dimer Acid/ Amine Salt | 70 | 50 | 25 | 50 | 50 |
| Fatty Alcohol (mixture of $C_{12}$ and $C_{14}$ alcohol) | 20 | 20 | 20 | | |
| Isopropyl Alcohol | | | | 20 | |
| Tridecyl Alcohol | | | | | 20 |
| Fatty Ester (mixture of $C_{12}$ and $C_{18}$ ester) | | | | 30 | 30 |
| Fatty Ester (mixture of $C_{16}$ and $C_{18}$ ester) | 10 | 30 | 55 | | |
| Properties | | | | | |
| Compatibility | OK | OK | OK | OK | OK |
| Emulsion Stability | OK | OK | POOR | OK | OK |
| Water Stain Test 5% Emulsion | OK | OK | OK | OK | OK |
| Falex Test 5% Emulsion | | | | | |
| Units Wear | 39 | *2 | 1 | 2 | 3 |
| EP | 2550 | 3200 | 2250 | 2650 | 2650 |

*1% Emulsion

The data in Table V would support various ranges for each of the components of the three-component lubricating system in order to achieve the best anti-wear properties and emulsion stability. Using the specific dimer acid/amine salt, aliphatic alcohols and fatty esters of the Table V, it may be observed that if the fatty ester is about 10% by weight that the units of wear are 39. Similarly, if the dimer acid/amine salt falls below about 25% the emulsion stability tends to be poor. Within the parameters of the data in Table V, the range of about 30 to about 60% by weight of the dimer acid/amine salt, about 20 to about 40% by weight of the aliphatic alcohol and about 20 to about 40% by weight of the fatty ester would be supported to achieve compatibility, emulsion stability, water stain resistance and anti-wear properties of an exceptional character.

Various alkanolamine salts of dimer acids and other fatty acids were prepared in equivalent ratios of 0.5/1.0 of the acid to the alkanolamine and their water stain resistant character was observed. The data are presented in Table VI.

TABLE VI

ALKANOLAMINE SALTS

| Composition in Equivalents: | | | | | | |
|---|---|---|---|---|---|---|
| E-1018 Dimer Acid | 0.5 | 0.5 | | | | |
| E-1012 Dimer Acid | | | 0.5 | | | |
| $C_{21}$ Dicarboxylic Acid | | | | 0.5 | | |
| Fatty/ Rosin Acid Mixture | | | | | 0.5 | |
| Oleic Acid | | | | | | 0.5 |
| Triethanolamine | 1.0 | | 1.0 | 1.0 | 1.0 | 1.0 |
| Diethanolamine | | 1.0 | | | | |
| Properties | | | | | | |
| Water Stain | | | | | | |
| 2% | NONE | NONE | NONE | STAIN | STAIN | STAIN |
| 5% | NONE | NONE | NONE | STAIN | STAIN | STAIN |
| Falex 2% | | | | | | |
| Units Wear | 100 | 63 | | | | 36 |
| EP | 2150 | 3200 | | | | 300 |
| Falex 5% | | | | | | |
| Units Wear | 54 | | | | | |
| EP | 3300 | | | | | |
| pH | | | | | | |
| 2% | 8.6 | 9.5 | | | | |
| 5% | 8.8 | 9.7 | | | | |

In the case of the dimer acid designated "E-1012", it is a dimer acid containing 87% $C_{36}$ dibasic acid, 3% $C_{54}$ tribasic acid and 10% monobasic (oleic) acid sold under the trademark EMPOL 1012 Dimer Acid. Both triethanolamine dimer acid salt and diethanolamine dimer acid salt prevented water staining at both 2% and 5% aqueous emulsion levels. Whereas in the cases of the alkanolamine salts of $C_{21}$ dicarboxylic acid, fatty/rosin acid mixture and oleic acid, at the same ratios staining of the aluminum strips resulted. Accordingly, these data demonstrate the unexpectedness of the activity of alkanolamine salts of dimer acid in the prevention of water staining where apparently similar fatty or other acids do not prevent such water stains.

Table VII similarly illustrates different fatty amine salt blends further including the presence of fatty methyl esters. Again, substantiating the data in Table VI, only the dimer acid/triethanolamine salts provided water stain resistance at both 2% and 5% aqueous emulsion levels with emulsion stability.

TABLE VII

DIFFERENT FATTY AMINE SALT BLENDS

| Composition Weight Percent | | | | | |
|---|---|---|---|---|---|
| Oleic Acid/TEA Salt | 50 | | | | |
| E-1018 Dimer Acid/TEA Salt | | 50 | | | |
| E-1012 Dimer Acid/TEA Salt | | | 50 | | |
| $C_{21}$ Dicarboxylic Acid/TEA Salt | | | | 50 | |
| Fatty/Rosin Acid Mixture/TEA Salt | | | | | 50 |
| Fatty Methyl Ester (mixture of $C_{12}$ and $C_{18}$ methyl ester) | 30 | 30 | 30 | 30 | 30 |
| Fatty Alcohol (mixture of $C_{12}$ and $C_{14}$ alcohol) | 20 | 20 | 20 | 20 | 20 |
| Properties | | | | | |
| Appearance | CLEAR | CLEAR | CLEAR | CLEAR | CLEAR |
| Emulsion Stability | GOOD | GOOD | GOOD | GOOD | GOOD |
| Water Stain | | | | | |
| 2% | STAIN | NONE | NONE | STAIN | STAIN |
| 5% | STAIN | NONE | NONE | STAIN | STAIN |
| Falex | | | | | |
| Units Wear | 0 | 1 | | | |
| EP | 3650 | 3350 | | | |
| pH | | | | | |
| 2% | 8.7 | 8.7 | 8.7 | 8.7 | 8.7 |
| 5% | 8.9 | 8.9 | 8.9 | 8.9 | 8.9 |

Different glycols such as ethylene glycol, diethylene glycol, hexylene glycol, and polyethylene glycol were substituted for the aliphatic monoalcohols of this invention and such diols do not provide compatible blends, but rather are hazy. The data are reported in Table VIII as follows.

TABLE VIII

DIFFERENT GLYCOLS

| Composition Weight Percent | | | | |
|---|---|---|---|---|
| E-1018 Dimer Acid/TEA Salt | 50 | 50 | 50 | 50 |
| Fatty Methyl Ester (mixture of $C_{12}$ and $C_{18}$ methyl ester) | 30 | 30 | 30 | 30 |
| Ethylene Glycol | 20 | | | |
| Diethylene Glycol | | 20 | | |
| Hexylene Glycol | | | 20 | |
| Polyethylene Glycol | | | | 20 |
| Properties | | | | |
| Appearance | HAZY | HAZY | HAZY | HAZY |

Blends using several different amine salt blends of fatty acid were prepared in combination with a fatty methyl ester and an oleic acid as a coupling agent. The data are presented in Table IX. All of the salts were made using triethanolamine as the alkanolamine in a ratio of 0.5/1.0 of the acid to the amine.

TABLE IX

DIFFERENT FATTY AMINE SALT BLENDS

| Composition Weight Percent | | | | | |
|---|---|---|---|---|---|
| E-1018 Dimer Acid/TEA Salt | | 20 | | | |
| E-1012 Dimer Acid/TEA Salt | | | 20 | | |
| $C_{21}$ Dicarboxylic Acid/Tea Salt | | | | 20 | |
| Oleic Acid/TEA Salt | | | | | 20 |
| Fatty Methyl Ester (mixture of $C_{12}$ and $C_{18}$ methyl ester) | | 65 | 65 | 65 | 65 |
| Oleic Acid | | 15 | 15 | 15 | 15 |
| Properties | | | | | |
| Appearance | | CLEAR | CLEAR | CLEAR | CLEAR |
| Emulsion Stability | | POOR | POOR | MODERATE | POOR |
| Water Stain | 1% | NONE | NONE | STAIN | STAIN |
| | 0.5% | NONE | | | |
| Falex | 1% | | | | |
| Units Wear | | 19 | 8 | | 12 |
| EP | | 1850 | 2000 | | 1200 |
| pH | 2% | 8.4 | | 8.4 | |
| | 5% | 8.7 | | 8.7 | |

The data in Table IX demonstrate that both dimer acid/TEA salts provided compositions which had water stain resistance at both the 1% and 0.5% level even though the emulsion exhibited poor stability. In contrast, the other acid salts of both $C_{21}$ dicarboxylic acid and oleic acid at the same levels resulted in stain of the aluminum strip. The emulsion stability of the dimer acid/TEA salts with oleic acid may be improved by increasing the oleic acid level to about 20–40% and also increasing the level of the dimer acid salt to between about 30 to about 60% by weight.

Different organic acids and diacids were attempted to be employed as coupling agents along with dimer acid/-TEA salt and fatty methyl ester blends in order to evaluate the performance of such acids in comparison to oleic acid. The data are reported in Table X.

TABLE X

DIFFERENT ACIDS

| Composition Weight Percent | | | | | | | |
|---|---|---|---|---|---|---|---|
| E-1018 Dimer Acid/TEA Salt | 50 | 50 | 50 | 50 | 50 | 50 | 50 |
| Fatty Methyl Ester (mixture of $C_{16}$ and $C_{18}$ methyl ester) | 30 | 30 | 30 | 30 | 30 | 30 | 30 |
| Oleic Acid | 20 | | | | | | |

TABLE X-continued

| DIFFERENT ACIDS | | | | | | | | |
|---|---|---|---|---|---|---|---|---|
| Adipic Acid | | | 20 | | | | | |
| Azelaic Acid | | | | 20 | | | | |
| Isophthalic Acid | | | | | 20 | | | |
| Boric Acid | | | | | | 20 | | |
| p-tert Butyl Benzoic Acid | | | | | | | 20 | |
| Dodecenyl Succinic Anhydride | | | | | | | | 20 |
| Properties | | | | | | | | |
| Appearance | | CLEAR | HAZY | HAZY | HAZY | HAZY | HAZY | HAZY |
| Emulsion Stability | | GOOD | | | | | | |
| Water Stain | 2% | NONE | | | | | | |
| | 5% | NONE | | | | | | |
| Falex | 1% | | | | | | | |
| Units Wear | | 19 | | | | | | |
| EP | | 1850 | | | | | | |
| Falex | 5% | | | | | | | |
| Units Wear | | 1 | | | | | | |
| EP | | 3350 | | | | | | |

Adipic acid, azelaic acid, isophthalic acid, boric acid, p-tert butyl benzoic acid and dodecenyl succinic anyhydride were blended with dimer acid/TEA salt and fatty methyl ester. These blends were compared to the oleic acid blend with the dimer acid/TEA salt and fatty methyl ester. In the case of the oleic acid blend, a clear blend was obtained where the emulsion stability was good. Furthermore, there was no water staining observed at both 2% and 5% emulsions. In contrast, all of the other organic acids produced a hazy appearance.

Blends employing the dimer/TEA salt the fatty alcohol and different esters were prepared and evaluated. The data are presented in Table XI.

TABLE XI

| DIFFERENT ESTERS | | | | | | |
|---|---|---|---|---|---|---|
| Composition Weight Percent | | | | | | |
| E-1018 Dimer Acid/TEA Salt | | 50 | 50 | 50 | 50 | 50 |
| Fatty Alcohol (mixture of $C_{12}$ and $C_{14}$ alcohol) | | 20 | 20 | 20 | 20 | 20 |
| Fatty Methyl Ester (mixture of $C_{12}$ and $C_{18}$ methyl ester) | | 30 | | | | |
| Fatty Methyl Ester (mixture of $C_{16}$ and $C_{18}$ methyl ester) | | | 30 | | | |
| Ditridecyl Adipate | | | | 30 | | |
| Ditridecyl Phthalate | | | | | 30 | |
| Pentaerythritol-tetra Pelargonate | | | | | | 30 |
| Properties | | | | | | |
| Appearance | | CLEAR | CLEAR | HAZY | HAZY | HAZY |
| Emulsion Stability | | GOOD | GOOD | | | |
| Water Stain | 2% | NONE | NONE | | | |
| | 5% | NONE | NONE | | | |
| Falex | 2% | | | | | |
| Units Wear | | *19 | 2 | | | |
| EP | | 1850 | 3200 | | | |
| Falex | 5% | | | | | |
| Units Wear | | 1 | | | | |
| EP | | 3350 | | | | |

*1% Emulsion

Blends made in accordance with the principles of this invention containing dimer acid/TEA salt, a fatty alcohol and a fatty methyl ester produced clear blends having a good emulsion stability at 2 and 5% levels. When the emulsions were tested for water staining resistance, each of the examples illustrated no water stains. In contrast, when the other esters, namely, ditridecyl adipate, ditridecyl phthalate and pentaerythritol-tetra pelargonate were tested at the same levels as the fatty methyl esters, hazy compositions were obtained.

Different fatty amine salts of dimer acid/TEA and dimer acid/DEA were prepared and blended with both a fatty alcohol and a fatty methyl ester in a three-component system according to the principles of this invention. For comparison, a salt of oleic acid/TEA was prepared. The levels of acid to triethanolamine in all cases were 0.5/1.0. The data are reported in Table XII.

TABLE XII

| DIFFERENT FATTY AMINE SALTS | | | | |
|---|---|---|---|---|
| Composition Weight Percent | | | | |
| E-1018 Dimer Acid/TEA | | 50 | | |
| E-1018 Dimer Acid/Diethanol Amine (DEA) | | | 45 | |
| Oleic Acid/TEA | | | | 50 |
| Fatty Alcohol (mixture of $C_{12}$ and $C_{14}$ alcohol) | | 20 | 25 | 20 |
| Fatty Methyl Ester (mixture of $C_{16}$ and $C_{18}$ methyl ester) | | 30 | 30 | 30 |
| Properties | | | | |
| Appearance | | CLEAR | CLEAR | CLEAR |
| Emulsion Stability | | GOOD | GOOD | GOOD |
| Water Stain | 2% | NONE | NONE | STAIN |
| | 5% | NONE | NONE | STAIN |
| Falex | 2% | | | |
| Units Wear | | *19 | 0 | |
| EP | | 1850 | 2650 | |
| Falex | 5% | | | |
| Units Wear | | 1 | | 0 |
| EP | | 3350 | | 3650 |
| pH | 2% | 8.8 | 9.4 | 8.4 |
| | 5% | 8.8 | 9.5 | 8.7 |

*1% Emulsion

The dimer acid salts of both triethanolamine and diethanolamine produced clear blends and emulsions having good stability. Tests for water staining at both 2% and 5% emulsion levels, produced excellent results in that no water stains were observed. In contrast, the oleic acid/TEA salt at the same level as the dimer acid/TEA salt produced water stains at both 2% and 5% emulsion levels. The wear properties as evidenced by the units of wear of both dimer acid/TEA and dimer acid/TEA blends were excellent or fair taking into consideration that the dimer acid/TEA value of 19 was obtained with a 1% emulsion.

Blends using mixtures of dimer/TEA salts containing oleic acids/TEA salts were prepared and compared to a blend simply containing oleic acid/TEA salt in order to evaluate their appearance, emulsion stabilizing characteristics and water staining resistance. The data are recorded in Table XIII.

TABLE XIII

| MIXED AMINE SALTS | | | |
|---|---|---|---|
| Composition Weight Percent | | | |
| E-1018 Dimer Acid/TEA Salt | 10 | | |
| E-1012 Dimer Acid/TEA Salt | | 10 | |
| Oleic Acid/TEA Salt | 50 | 40 | 50 |
| Fatty Alcohol (mixture of $C_{12}$ and $C_{14}$ alcohol) | 20 | 20 | 20 |
| Fatty Methyl Ester (mixture of $C_{12}$ and $C_{18}$ methyl ester) | 30 | 30 | 30 |
| Properties | | | |
| Appearance | CLEAR | CLEAR | CLEAR |
| Emulsion Stability | GOOD | GOOD | GOOD |
| Water Stain 2% | NONE | NONE | STAIN |
| 5% | NONE | NONE | STAIN |

The oleic acid/TEA salt alone in the blend with a fatty alcohol and fatty methyl ester produced a clear blend having good emulsion stability. However, at both 2% and 5% emulsion levels, staining occurred. In contrast, when 10 parts of the dimer acid/TEA salt were substituted for the oleic acid/TEA salt, the staining of the aluminum strip was avoided. This illustrates the fact that the dimer acid/TEA salts of this invention wherein polymeric fatty acids of either $C_{36}$, $C_{54}$ or similar nature are prepared with alkanolamines, that the water staining characteristics of a lubricant composition may be avoided.

Several blends were prepared employing dimer acid, fatty methyl ester, fatty alcohol and an emulsifier in place of the alkanolamine salt for the purpose of obtaining a water active system and to compare such blends with the blends made in accordance with the principles of this invention. The data are presented in Table XIV.

TABLE XIV

| BLENDS USING AN EMULSIFIER | | | | |
|---|---|---|---|---|
| Composition Weight Percent | | | | |
| E-1018 Dimer Acid | 40 | 42.5 | 45 | 47.5 |
| Fatty Methyl Ester (mixture of $C_{12}$ and $C_{18}$ methyl ester) | 24 | 25.5 | 27 | 28.5 |
| Fatty Alcohol (mixture of $C_{12}$ and $C_{14}$ alcohol) | 16 | 17.0 | 18 | 19.0 |
| Ethoxylated Nonyl Phenol | 20 | 15.0 | 10 | 5.0 |
| Properties | | | | |
| Appearance | CLEAR | CLEAR | CLEAR | CLEAR |
| Emulsion Stablilty | GOOD | GOOD | POOR | POOR |
| Water Stain 5% | STAIN | STAIN | NONE | NONE |

TABLE XIV-continued

| BLENDS USING AN EMULSIFIER | | | | |
|---|---|---|---|---|
| pH 5% | 6.0 | 6.0 | 6.0 | 6.0 |

At various levels of between about 5 to about 20 weight percent of ethyoxlated nonyl phenol as the emulsifier, where the emulsion stability was good, water staining occurred. In contrast, where the emulsion stability was poor, no water staining was observed under tests. Thus, where an emulsifier was added to a system of dimer acid, fatty methyl ester, and fatty alcohol in contrast to the dimer acid/TEA salt of this invention, either poor emulsion stability or water staining occurred. Accordingly, this demonstrates again the advantageous properties of the blends made in accordance with the principles of this invention in comparison to other blends as well as the rather unexpected behavior of the alkanolamine salts of dimer acid in the three-component system of this invention. Table XV presents typical physical properties of such a blend.

TABLE XV

| TYPICAL PHYSICAL PROPERTIES | |
|---|---|
| Composition Weight Percent | |
| E-1018 Dimer Acid/TEA Salt | 50 |
| Fatty Methyl Ester (mixture of $C_{12}$ and $C_{18}$ methyl ester) | 30 |
| Fatty Alcohol (mixture of $C_{12}$ and $C_{14}$ alcohol) | 20 |
| Properties | |
| Appearance | Clear amber liquid |
| Viscosity, 100° F. | |
| cSt | 147 |
| S U S | 681 |
| Flash Point °F. | 260 |
| Fire Point °F. | 280 |
| Specific Gravity, 25° C. | .913 |
| A P I Gravity | 23.48 |
| Lbs/Gal. | 7.6 |
| Amine Value | 96.5 |
| Amine Value (Theo.) | 96.1 |

Dimer acids employed in the above examples may be generally defined as containing greater than 75 percent by weight $C_{36}$ dibasic acid and having an iodine value up to about 110. Both EMPOL 1012 and 1018 were employed in the examples. These dibasic acids have been identified above. In addition, other dimer acids ate available commercially, for instance, EMPOL 1010 Dimer Acid which contains about 97% by weight $C_{36}$ dimer acid. Dimer acids are polymer acids obtained by reacting two fatty molecules of $C_{18}$ acids, such as oleic acid, linoleic acid or mixtures thereof (e.g. tall oil fatty acids). In comparison to other acids, dimer is especially useful and advantageously employed in the preparation of salts for lubricant compositions of this invention. These useful acids have as their principal component $C_{36}$ dimer acid and, as pointed out above, are commercially available under the trademark EMPOL. Nevertheless, as also developed above, other polymeric acids containing mainly $C_{54}$ timer acid as their principal component are available and are useful. For instance, EMPOL 1040 trimer acid contains about 90% $C_{54}$ trimer acid and about 10% $C_{36}$ dimer or dibasic acid. In accordance with the principles of this invention, the polymeric fatty acids are selected from the group consisting of $C_{36}$ dimer acid, $C_{54}$ trimer acid and mixtures thereof, taking into consideration that a person of ordinary skill understands that the polybasic acids utilized in the present invention are obtained by the polymerization of unsaturated monocarboxylic acids of $C_{18}$ acids as mentioned above to result in the $C_{36}$ dimer acid, $C_{54}$ trimer acid and mixtures thereof. In the case of dimer acids containing less than 25% trimer or higher polymer acids, if desired, as is the case with EMPOL 1012, the unsaturation may be hydrogenated and molecularly distilled for use in the preparation of the lubricant blends of this invention. These polymeric acids are well known in the art and their methods for preparation are equally known and, besides, are commercially available. Patents which have employed dimer and trimer acids in lubricating oil compositions include U.S. Pat. No. 4,132,662 issued to Sturwold and U.S. Pat. No. 4,153,464 issued to Sturwold et al.

Other modifications and variations of the metalworking lubricant compositions of this invention may be made without departing from the spirit and scope of this invention.

What is claimed is:

1. A water active metalworking lubricant composition containing (a) an alkanolamine salt of a polymeric fatty acid selected from the group consisting of a $C_{36}$ dimer acid, a $C_{54}$ trimer acid and mixtures thereof, (b) an organic compound selected from the group consisting of an aliphatic monoalcohol and an aliphatic monocarboxylic acid, and (c) an alkyl ester of a fatty acid.

2. The composition of claim 1 wherein said alkanolamine is selected from the group consisting of monoethanolamine, diethanolamine, triethanolamine and triisopropanolamine.

3. The composition of claim 1 wherein said acid and said amine are present in the salt in equivalent amounts within the range of about 0.3–1 to about 1.

4. The composition of claim 1 wherein said salt is contained in an amount within the range of about 30% to about 60% by weight, said alcohol or acid is contained in an amount from about 20% to about 40% by weight and said fatty acid ester is contained in an amount of from about 20% to about 40% by weight.

5. The composition of claim 1 wherein said aliphatic monoalcohol is a fatty alcohol having from about 12 to about 22 carbon atoms.

6. A water active rolling composition for the prevention of water staining in metal sheets of non-ferrous metals such as aluminum or aluminum alloys containing (a) an alkanolamine salt of a polymeric fatty acid selected from the group consisting of a $C_{36}$ dimer acid, a $C_{54}$ trimer acid and mixtures thereof, wherein said alkanolamine is selected from the group consisting of monoethanolamine, diethanolamine, triethanolamine and triisopropanolamine, (b) a fatty alcohol or a fatty acid containing from about 12 to about 22 carbon atoms, (c) a lower alkyl ester of a fatty acid containing from about 12 to about 22 carbon atoms.

7. The composition of claim 6 wherein said fatty acid ester is a methyl ester.

8. The composition of claim 6 wherein said acid and said amine are present in the salt in equivalent amounts within the range of about 0.3–1 to about 1.

9. The composition of claim 6 wherein said salt is contained in an amount within the range of about 30% to about 60% by weight, said alcohol or acid is contained in an amount from about 20% to about 40% by weight and said fatty acid ester is contained in an amount of from about 20% to about 40% by weight.

10. A method for working a metal which comprises applying to the surface of the metal an effective amount of an aqueous lubricant composition containing water and a water active lubricant from about 1 to about 10% by weight containing (a) from about 30 to about 60% by weight of a polymeric fatty acid selected from the group consisting of a $C_{36}$ dibasic acid, a $C_{54}$ tribasic acid and mixtures thereof, (b) from about 20% to 40% by weight of a fatty alcohol or fatty acid having from about 12 to about 22 carbon atoms, and (c) from about 20% to about 40% by weight of a lower alkyl ester of a fatty acid having from about 12 to about 22 carbon atoms.

11. The method of claim 10 wherein the lubricant composition is contained in an amount from about 2 to about 5% by weight, the polymeric acid is a $C_{36}$ dimer acid containing greater than about 75% by weight $C_{36}$ dimer acid, said fatty alcohol or acid having from about 12 to 18 carbon atoms and said ester is a methyl ester of a $C_{12}$ to $C_{18}$ fatty acid.

12. The method of claim 11 wherein said composition is applied in a process for cold rolling aluminum or aluminum metal alloy.

* * * * *